US008707666B2

(12) United States Patent
Crozier et al.

(10) Patent No.: US 8,707,666 B2
(45) Date of Patent: Apr. 29, 2014

(54) SHORT SPLICE SYSTEMS AND METHODS FOR ROPES

(75) Inventors: Casey Crozier, Broussard, LA (US); David Johnathan Laundry, Ferndale, WA (US)

(73) Assignee: Samson Rope Technologies, Ferndale, WA (US)

( * ) Notice: Subject to any disclaimer, the term of this patent is extended or adjusted under 35 U.S.C. 154(b) by 86 days.

(21) Appl. No.: 13/431,829

(22) Filed: Mar. 27, 2012

(65) Prior Publication Data

US 2012/0266583 A1 Oct. 25, 2012

Related U.S. Application Data

(60) Provisional application No. 61/468,985, filed on Mar. 29, 2011.

(51) Int. Cl.
*B65H 69/06* (2006.01)

(52) U.S. Cl.
USPC ..... 57/22; 57/202

(58) Field of Classification Search
USPC ..... 57/22, 23, 202
See application file for complete search history.

(56) References Cited

U.S. PATENT DOCUMENTS

| | | | | |
|---|---|---|---|---|
| 429,174 | A | 6/1890 | Ogilvy | |
| 568,531 | A | 9/1896 | Harthan | |
| 1,257,398 | A | 2/1918 | Roach | |
| 1,839,698 | A * | 1/1932 | Novotny | 57/202 |
| 2,070,362 | A | 2/1937 | Kreutz | |
| 2,299,568 | A | 10/1942 | Dickey | |
| 2,454,592 | A * | 11/1948 | Budzinski | 57/202 |
| 2,840,983 | A | 7/1958 | Keilbach | |
| 3,276,810 | A | 10/1966 | Antell | |
| 3,295,303 | A * | 1/1967 | Beveridge | 57/23 |
| 3,411,400 | A | 11/1968 | Morieras et al. | |
| 3,653,295 | A | 4/1972 | Pintard | |
| 3,771,305 | A | 11/1973 | Barnett | |
| 3,904,458 | A | 9/1975 | Wray | |
| 4,036,101 | A | 7/1977 | Burnett | |
| 4,056,928 | A | 11/1977 | de Vries | |
| 4,114,360 | A * | 9/1978 | Emmons | 57/202 |
| 4,170,921 | A | 10/1979 | Repass | |
| 4,191,009 | A * | 3/1980 | Thomson | 57/202 |
| 4,232,619 | A | 11/1980 | Lindahl | |
| 4,286,429 | A | 9/1981 | Lin | |
| 4,414,799 | A * | 11/1983 | Alexander et al. | 57/22 |
| 4,619,108 | A | 10/1986 | Hotta | |
| 4,779,411 | A | 10/1988 | Kendall | |
| D338,171 | S | 8/1993 | Bichi | |
| 5,426,788 | A | 6/1995 | Meltzer | |
| 5,636,506 | A | 6/1997 | Yngvesson | |
| 6,015,618 | A | 1/2000 | Orima | |
| 6,422,118 | B1 | 7/2002 | Edwards | |
| 7,107,749 | B2 * | 9/2006 | Wetzels et al. | 57/22 |
| 7,127,878 | B1 | 10/2006 | Wilke et al. | |

(Continued)

*Primary Examiner* — Shaun R Hurley
(74) *Attorney, Agent, or Firm* — Michael R. Schacht; Schacht Law Office, Inc.

(57) ABSTRACT

A rope system comprising a rope structure comprising an intact portion comprising intact strands and a disassembled portion comprising loose strands. The loose strands are passed into an interior of the rope structure. Each loose strand is passed from the interior of the rope structure to the exterior of the rope structure adjacent to an associated intact strand. Each loose strand is extended along and wrapped around its associated intact strand at at least one wrap location.

14 Claims, 10 Drawing Sheets

(56) References Cited

U.S. PATENT DOCUMENTS

| | | | | |
|---|---|---|---|---|
| 7,134,267 | B1 | 11/2006 | Gilmore et al. | |
| 7,165,485 | B2 | 1/2007 | Smeets et al. | |
| 7,168,231 | B1 | 1/2007 | Chou et al. | |
| 7,367,176 | B1 | 5/2008 | Gilmore et al. | |
| 7,389,973 | B1 | 6/2008 | Chou et al. | |
| 7,437,869 | B1 | 10/2008 | Chou et al. | |
| D592,537 | S | 5/2009 | Darnell | |
| 7,568,419 | B2 | 8/2009 | Bosman | |
| 7,735,308 | B1 | 6/2010 | Gilmore et al. | |
| 7,739,863 | B1 | 6/2010 | Chou et al. | |
| 7,743,596 | B1 | 6/2010 | Chou et al. | |
| 7,908,955 | B1 | 3/2011 | Chou et al. | |
| 8,109,071 | B2 | 2/2012 | Gilmore | |
| 8,109,072 | B2 | 2/2012 | Chou et al. | |
| 8,171,713 | B2 | 5/2012 | Gilmore et al. | |
| 8,171,714 | B2 | 5/2012 | Wienke et al. | |
| 8,341,930 | B1 | 1/2013 | Chou et al. | |
| 8,381,504 | B2 * | 2/2013 | Pettersen | 57/22 |
| 8,387,505 | B2 | 3/2013 | Chou et al. | |
| 2006/0048494 | A1 | 3/2006 | Wetzels et al. | |
| 2012/0266583 | A1 | 10/2012 | Crozier et al. | |
| 2012/0297746 | A1 | 11/2012 | Chou et al. | |

* cited by examiner

SHORT SPLICE SYSTEMS AND METHODS FOR ROPES

RELATED APPLICATIONS

This application, U.S. patent application Ser. No. 13/431,829, claims benefit of U.S. Provisional Application Ser. No. 61/468,985 filed Mar. 29, 2011, the contents of which are incorporated herein by reference.

TECHNICAL FIELD

The present invention relates to rope systems and methods and, more specifically to systems and methods for splicing ropes.

BACKGROUND

Rope splicing refers to the formation of a joint between two ropes or two parts of the same rope by partly untwisting and interweaving strands of the rope or ropes.

A splice can retain a very high percentage of the strength of the unspliced rope, but the splice tends to create a thickened portion of the rope. In some situations, this thickened portion of the rope does not adversely affect the use of the rope. In other situations, a thickened region of a rope can alter the operating characteristics of the rope and/or the manner in which the rope interacts with structures or mechanical assemblies for guiding and/or securing the rope.

The present invention relates to a particular form of rope splicing referred to as a short splice. A short splice minimizes the length of the thickened portion of the rope and thus minimizes some of the adverse effects of the splice on the operating characteristics of the rope.

The present invention is of particular significance in the context of forming an eye splice, and that application of the present invention will be described herein in detail. However, the principles of the present invention may have application to splices other than eye splices where short splices may be used.

The need thus exists for improved short splice systems and methods for ropes.

SUMMARY

The present invention may be embodied as a rope system comprising a rope structure comprising an intact portion comprising intact strands and a disassembled portion comprising loose strands. The loose strands are passed into an interior of the rope structure. Each loose strand is passed from the interior of the rope structure to the exterior of the rope structure adjacent to an associated intact strand. Each loose strand is extended along and wrapped around its associated intact strand at at least one wrap location.

The present invention may also be embodied as a rope system comprising a braided rope structure defining an interior and an exterior and comprising an intact portion comprising a plurality of intact S-strands and a plurality of intact Z-strands and a disassembled portion comprising a plurality of loose strands. Each intact S-strand crosses a plurality of intact Z-strands. Each intact Z-strand crosses a plurality of intact S-strands. The plurality of loose strands is passed into the interior of the rope structure. Each loose strand is passed from the interior of the rope structure to the exterior of the rope structure adjacent to one of an associated intact S-strand and an associated intact Z-strand. Each loose strand associated with one of the intact S-strands is extended under at least one intact Z-strand crossing the associated intact S-strand and over at least one intact Z-strand crossing the associated intact S-strand and wrapped around its associated intact S-strand. Each loose strand associated with one of the intact Z-strands is extended under at least one intact S-strand crossing the associated intact Z-strand and over at least one intact S-strand crossing the associated intact Z-strand and wrapped around its associated intact Z-strand.

The present invention may also be embodied as a method of forming a rope system comprising the following steps. A braided rope structure defining an interior and an exterior is provided. The braided rope structure comprises an intact portion comprising a plurality of intact S-strands and a plurality of intact Z-strands and a disassembled portion comprising a plurality of loose strands. Each intact S-strand crosses a plurality of intact Z-strands. Each intact Z-strand crosses a plurality of intact S-strands. The plurality of loose strands is passed into the interior of the rope structure. Each loose strand is passed from the interior of the rope structure to the exterior of the rope structure. Each loose strand is associated with one of the intact S-strands or one of the intact Z-strands. Each loose strand associated with one of the intact S-strands is extended under at least one intact Z-strand crossing the associated intact S-strand and over at least one intact Z-strand crossing the associated intact S-strand. Each loose strand associated with one of the intact S-strands is wrapped around its associated intact S-strand. Each loose strand associated with one of the intact Z-strands extends under at least one intact S-strand crossing the associated intact Z-strand and over at least one intact S-strand crossing the associated intact Z-strand. Each loose strand associated with one of the intact Z-strands is wrapped around its associated intact Z-strand.

DETAILED DESCRIPTION

Figure 1:
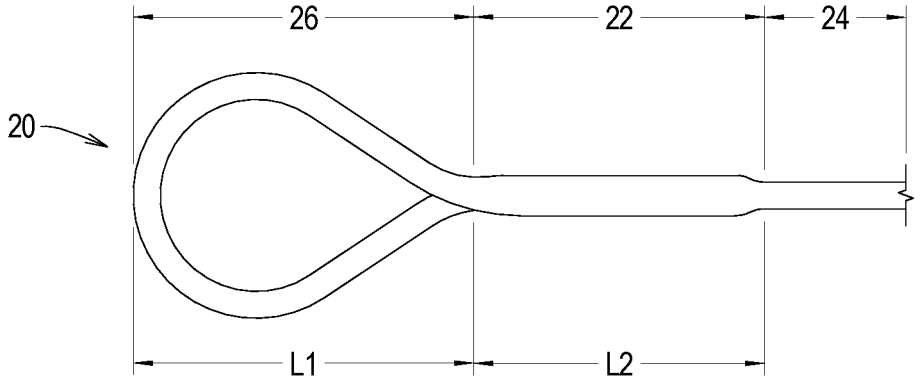
FIG. 1 is a top plan view of a rope structure using an example splice system constructed in accordance with, and embodying, the principles of the present invention.
Figure 2:
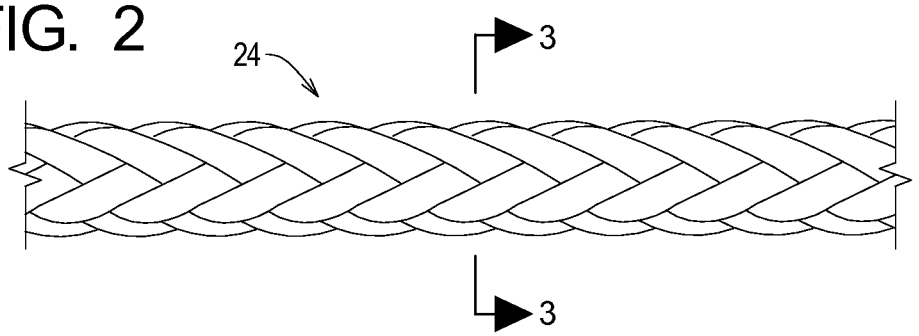
FIG. 2 is a side elevation view of a portion of the rope system of FIG. 1.
Figure 3:
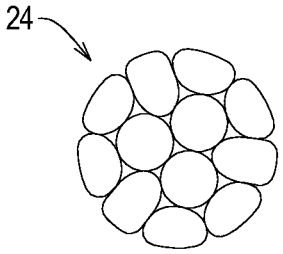
FIG. 3 is a section view taken along lines 3-3 in FIG. 2.

Referring initially to FIG. 1 of the drawing, depicted at 20 therein is an example rope system comprising a splice system 22 constructed in accordance with, and embodying, the principles of the present invention. The example splice system 22 defines a main portion 24 and an eye portion 26 of the rope system 20. FIG. 2 depicts a section of the main portion 24, and FIG. 3 illustrates that the main portion 24 of the example rope system 20 is formed by length of a twelve strand rope.

Referring now to FIGS. 4-8, the formation of the example splice system 22 and rope system 20 will be described in further detail. Initially, a rope structure 30 is provided defining a first or proximal end 32 (may also be referred to as the bitter end) and a second or distal end 34 (may also be referred to as the standing end). The example rope structure 30 is a twelve strand rope and starts off in what will be referred to as an initial configuration as depicted in FIG. 4A.

Figure 4A:
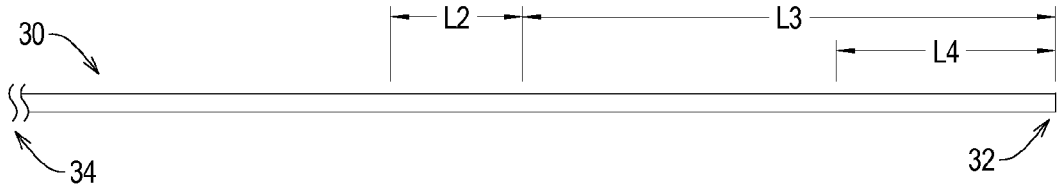
FIGS. 4A-4F illustrate a process of forming the example splice system of the rope system of FIG. 1.
Figure 4B:
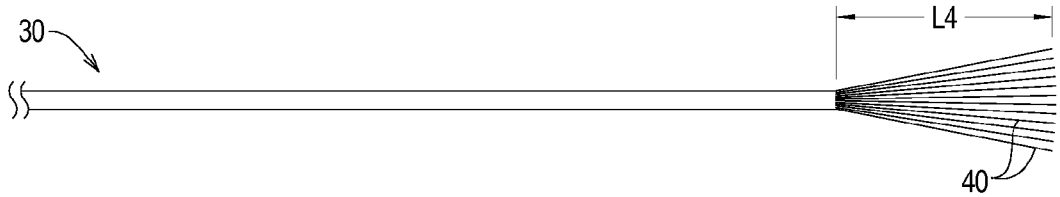
Figure 4C:
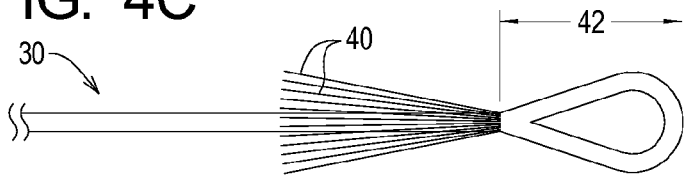
Figure 4D:
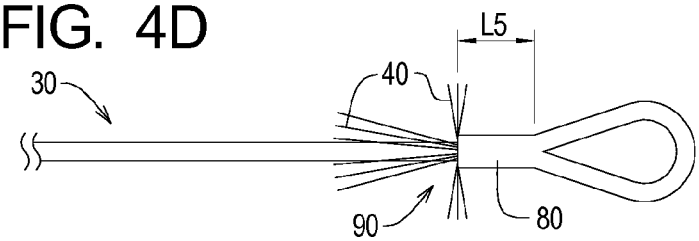
Figure 4E:
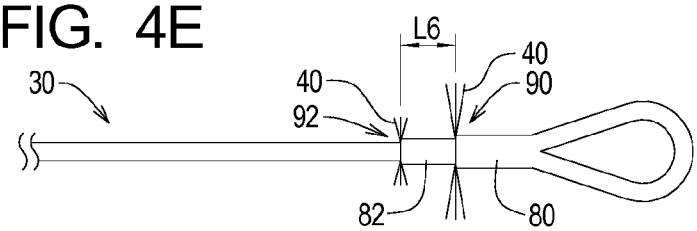
Figure 4F:
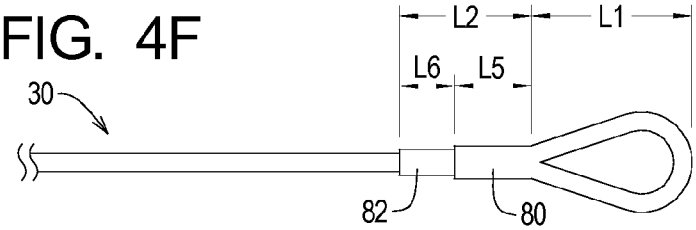

Referring for a moment to FIGS. 1 and 4F, it can be seen that an eye length L1 of the eye portion 26 is initially determined based on the prospective use and dimensions of the rope system 20. A splice length L2 of the splice system 22 as shown in FIGS. 1 and 4A is next determined based on the prospective use and dimensions of the rope system 20 as well as the prospective use and dimensions of the eye portion 26. Based on the eye length L1 and the splice length L2, a working length L3 as shown in FIG. 4A is next determined. The working length L3 is associated with a portion of the rope structure 30 that is long enough to form the eye portion 26 and splice system 22 without excessive waste of the rope structure 30.

Based on the splice length L2, a loose strand length L4 is determined as shown in FIGS. 4A and 4B. The loose strand length L4 is associated with a portion of the rope structure 30 that is untwisted, unbraided, or otherwise disassembled to obtain individual loose strands 40 of the rope structure having sufficient length to form the splice system 22. This loose strand length L4 should allow the individual loose strands 40 to be worked as will be described in further detail below.

Next, as perhaps best shown in FIG. 4C, the first end 32 of the rope structure 30 is looped back on itself in a loop configuration to form a loop portion 42. In the loop configuration, the splice system 22 has yet to be formed, but the loop portion 42 has substantially the same dimensions as the eye portion 26 of the rope system 20.

Figure 5A:
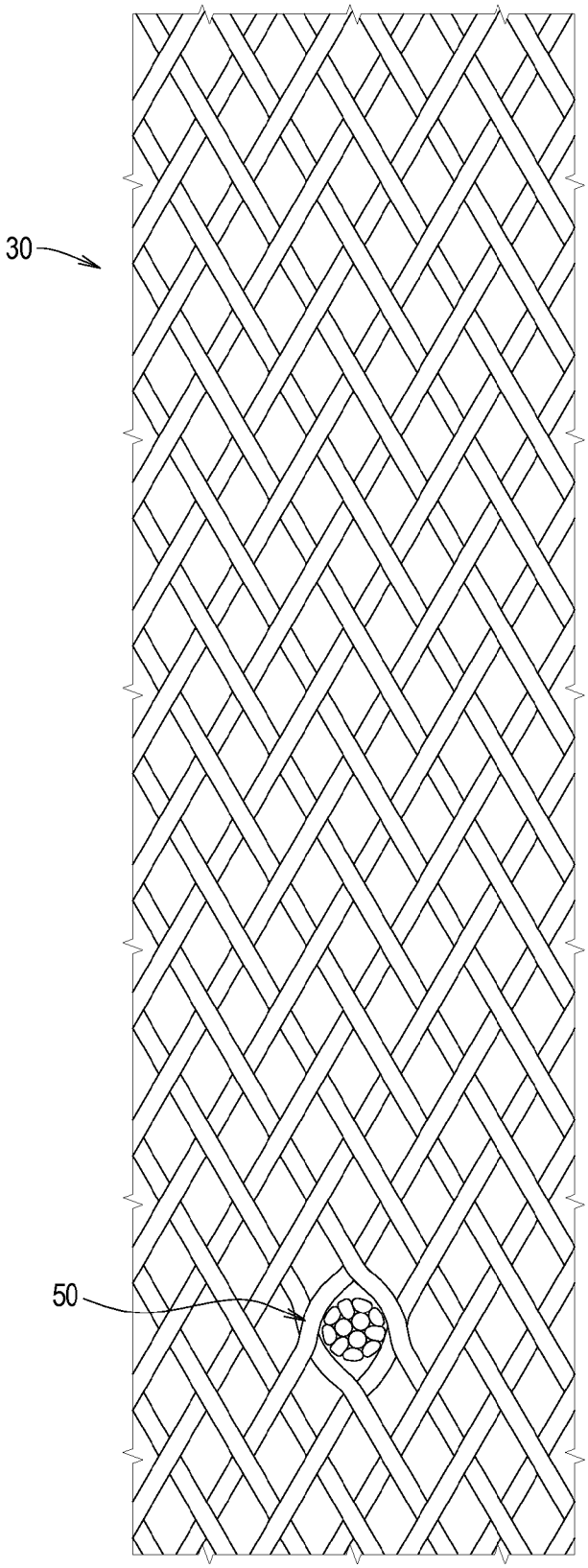
FIG. 5A is a two-dimensional view of a rope structure illustrating a beginning location at which the example splice process is initiated.
Figure 5B:
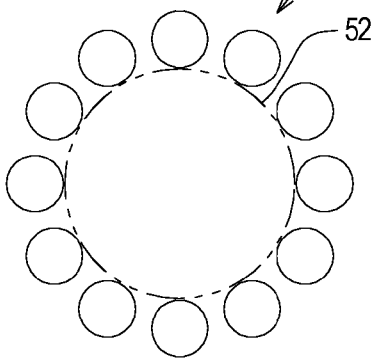
FIG. 5B is a section view of the rope structure illustrating an interior space defined by the rope structure.

With the rope structure in the loop configuration as shown in FIG. 4C, the loose strands 40 are inserted as individually or as a bundle (still untwisted, unbraided, or otherwise disassembled) into the rope structure at a beginning location 50 as shown in FIG. 5. It should be noted that FIG. 5 is somewhat schematic in that the three-dimensional rope structure 30 is represented in two-dimensions. In particular, when loosened (e.g., removing tension on the rope structure) the example rope structure 30 takes the form of a hollow, generally cylindrical structure having an interior space 52. As depicted in FIG. 5, the left and right edges of the rope structure 30 may be rolled together and connected to define this cylindrical structure. The ends of the loose strands 40 are inserted into the interior space 52 of the rope structure 30 at the beginning location 50.

Figure 6:
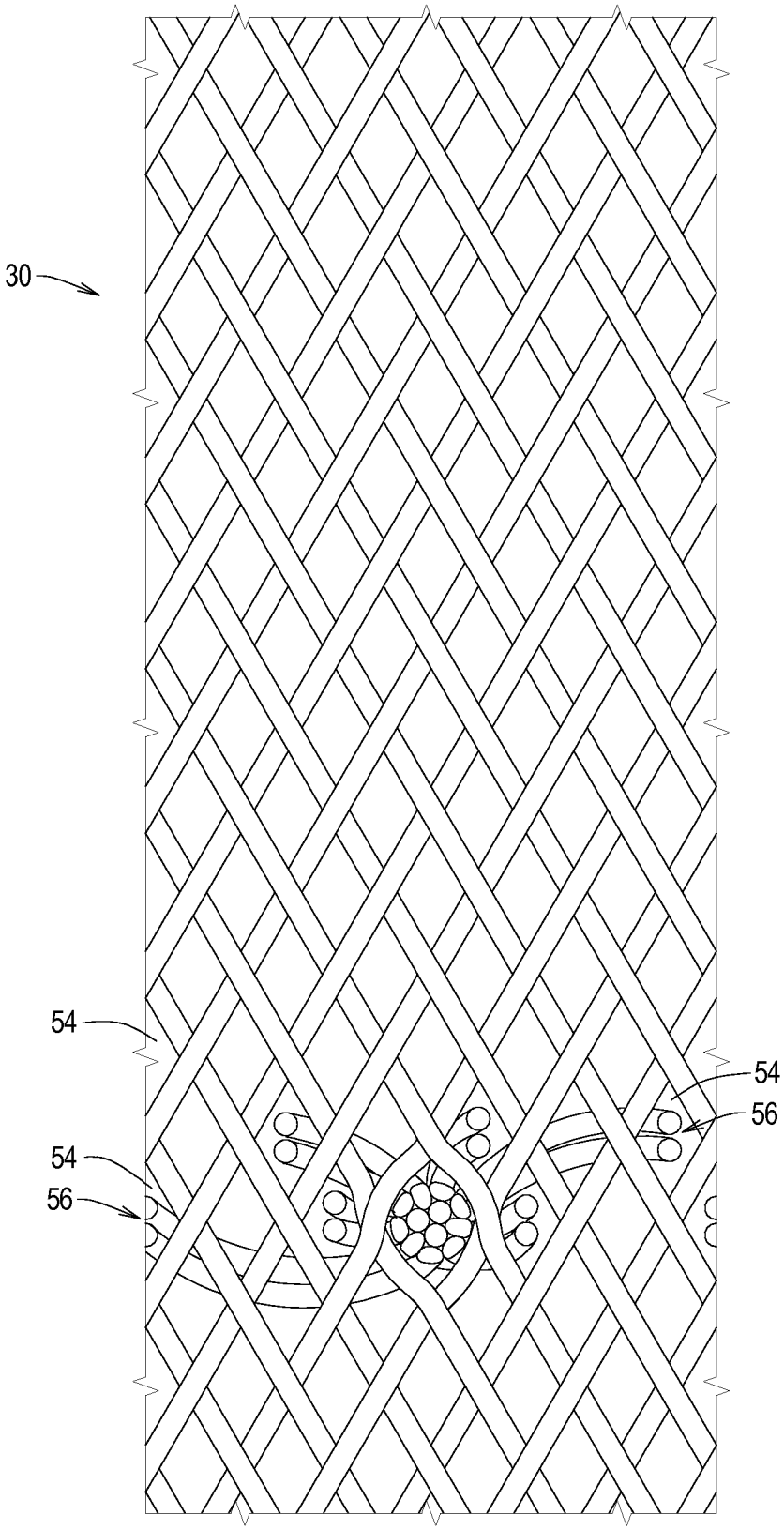
FIG. 6 is a two-dimensional view illustrating a first step of the example splice process.
Figure 7:
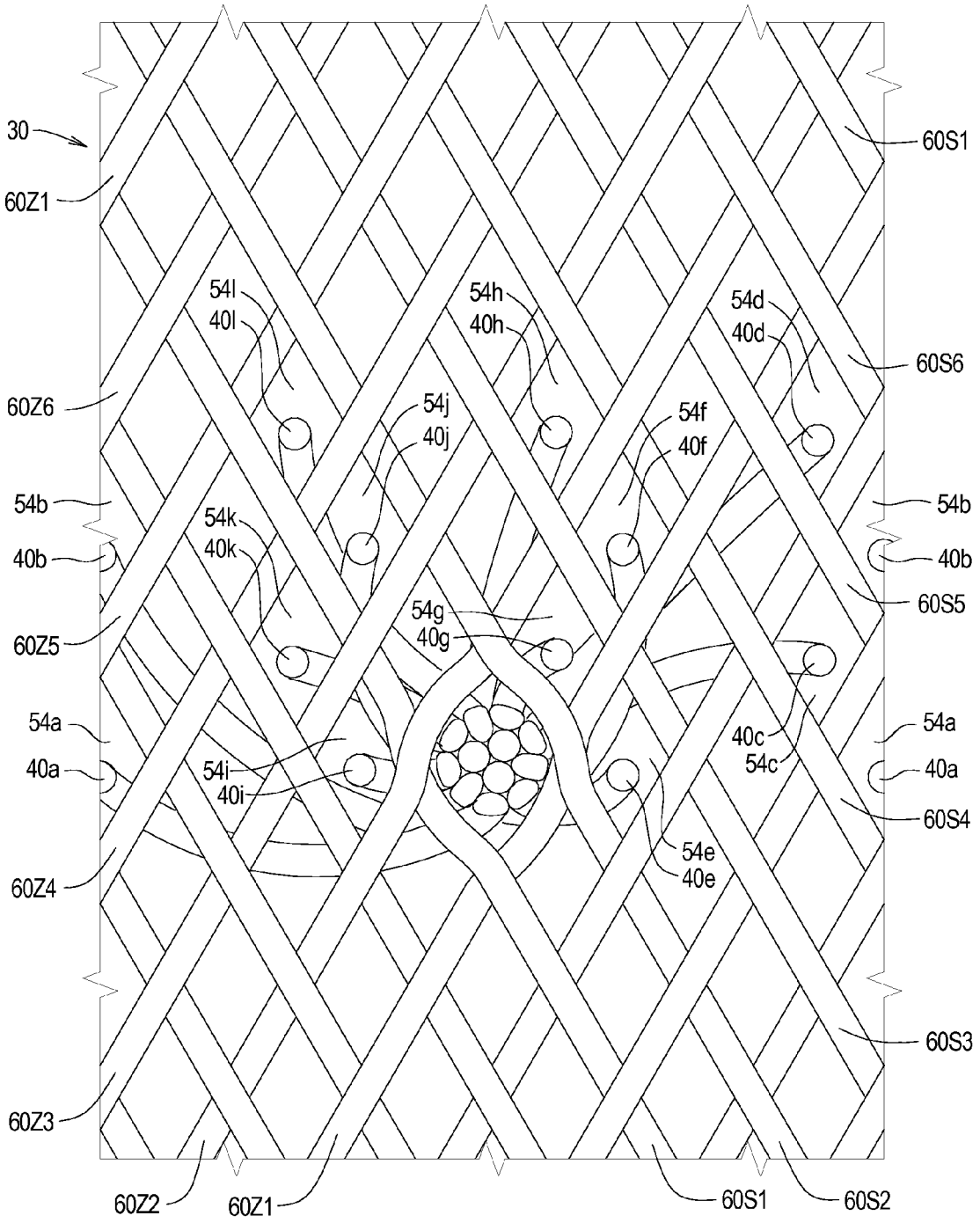
FIG. 7 is a two-dimensional view illustrating a second step of the example splice process.

Next, as shown in FIGS. 6 and 7, the ends of the loose strands 40 are passed from the inside of the rope structure 30 to the outside of the rope structure at a plurality of exit locations 54. In the example shown in FIGS. 6 and 7, the ends of the loose strands 40 are initially passed through a subset of the exit locations 54 in pairs 56 as shown in FIG. 6. Then, as shown in FIG. 7, one strand out of each of the pairs 56 of loose strands 40 is removed from its initial exit position and inserted back into the interior of the rope structure 30 and back out another one of the exit locations 54. In the example rope system 20, each of the loose strands 40 eventually extends from the interior of the rope structure 30 to the exterior of the rope structure 30 through a unique exit location 54 as shown in FIG. 7. At the point shown in FIG. 7, each of the loose strands 40 may be associated with an intact strand 60 of a portion of the rope structure 30 that is still intact (e.g., not untwisted, unbraided, or otherwise disassembled).

At this point, it should be noted that the individual braids of a braided rope structure are aligned with what is typically referred to as an S-axis or a Z-axis associated with the rope structure. The S- and Z-axes are both generally helical shapes that extend or are twisted in opposite directions. A given braided rope structure will define either an S-axis or a Z-axis for each strand of the rope. The S-axes are typically radially offset from each other, and the Z-axes are typically radially offset from each other. The S-axes are intertwined with the Z-axes for a particular rope structure. Typically, one half of the strands of any given rope structure will lie along the S-axis, and the other half will lie along the Z-axis. The "S" and "Z" in the terms "S-axis" identify the direction of the twist of the particular helical axis. In particular, the center portions of the letter "S" and the letter "Z" extend from bottom right to top left and bottom left to top right, respectively, and thus the use of these letters forms a mnemonic device for remembering and identifying the axes along which the strands of a braided rope structure extend. Accordingly, from either end of a length of rope, strands extending along the S-axis of the rope thus extend from lower left to upper right, while strands extending along the Z-axis of the rope extend from lower right to upper left. This S-axis/Z-axis reference system will be used in the remaining discussion of the example rope system 20.

The example rope structure 30, being a twelve strand braided rope, defines six S-axes and six Z-axes. As an additional shorthand, intact strands 60 extending along S-axes will be referred to as intact S-strands, while intact strands 60 extending along the Z-axes will be referred to as intact Z-strands. For consistency, the intact S-strands will be referred to using the reference character 60S and the intact Z-strands will be referred to using the reference character 60Z. When individual S-strands or Z-strands are identified, a numerical designator (e.g., 60Z1) will be appended to these reference characters. For clarity, lower case letters will be appended to the reference character "40" associated with individual loose strands 40 (e.g., 40*a-l*). Similarly, lower case letters will be appended to the reference character "52" associated with individual exit locations 54 (e.g., 52*a-l*)

Figure 8:
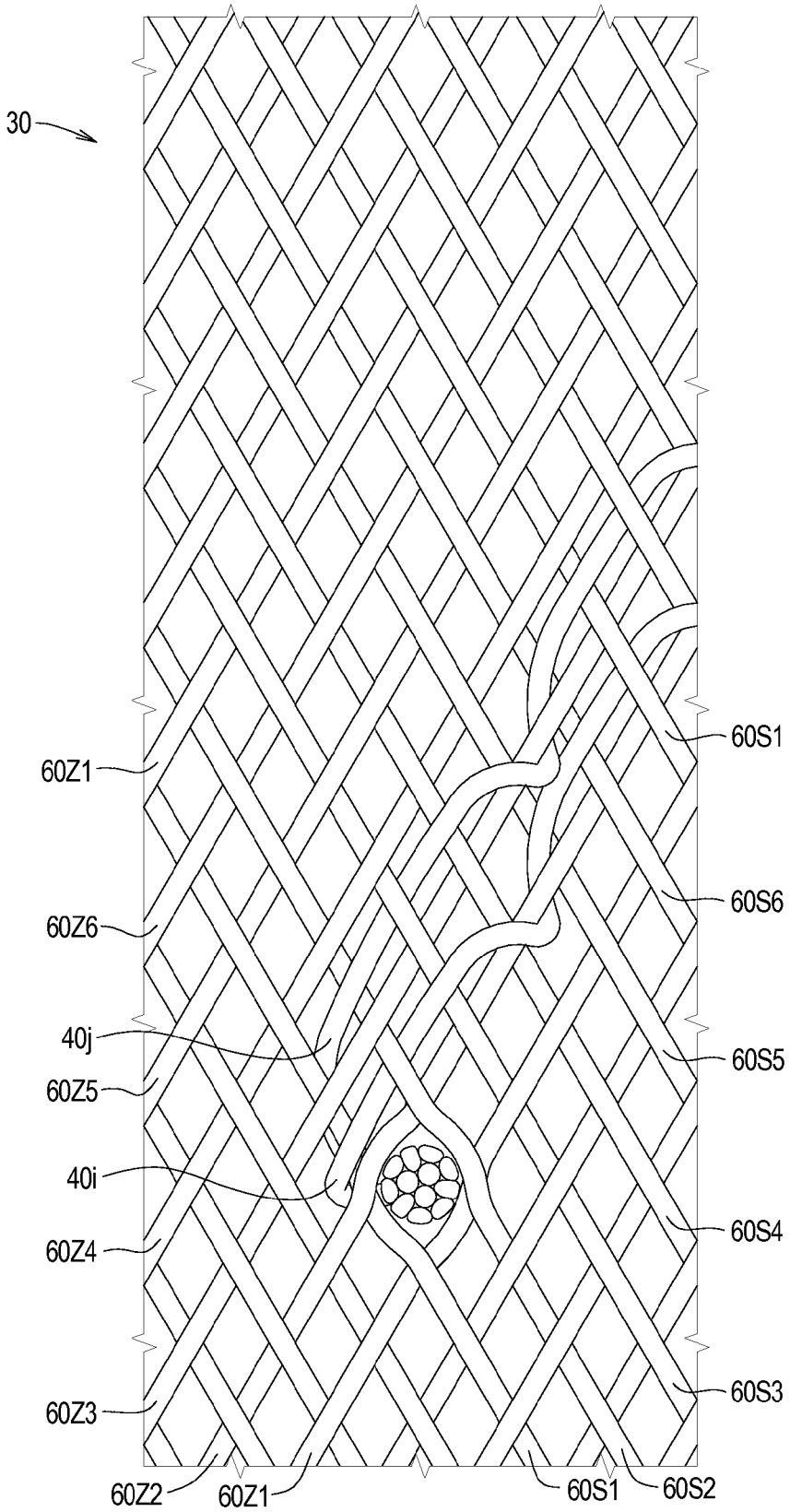
FIG. 8 is a two-dimensional view illustrating portions of example following steps of the example splice process.
Figure 9:
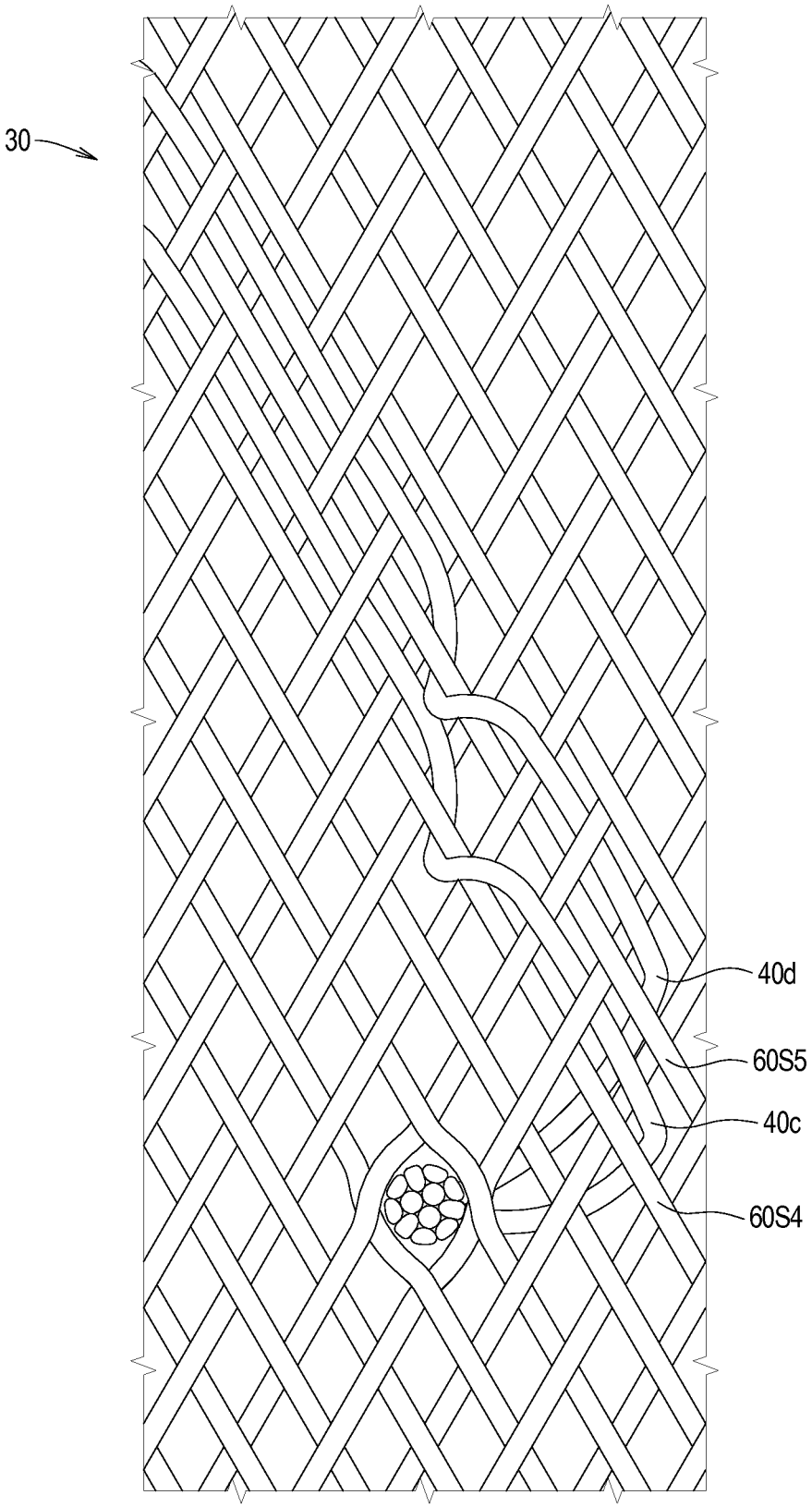
FIG. 9 is a two-dimensional view illustrating portions of example following steps of the example splice process.

Referring for a moment back to FIG. 7, it can be seen that, with the ends of the loose strands 40 extending from the exit locations 54, each end of the individual loose strands 40 can be associated with either an intact S-strand 60Z or an intact Z-strand 60Z. Further, as shown in FIGS. 8 and 9, each individual end of the loose strands 40 is associated with a unique intact S-strand 60 or intact Z-strand 60. In particular, the following Table A indicates the associations between each of the ends of the twelve loose strands 40 with the six intact S-strands 60S and the six intact Z-strands 60Z and also identifies the exit location 54 associated with each of the loose strands 40:

TABLE A

| LOOSE STRANDS | INTACT STRANDS | EXIT LOCATION |
|---|---|---|
| 40a | 60Z4 | 52a |
| 40b | 60Z5 | 52b |
| 40c | 60S4 | 52c |

TABLE A-continued

| LOOSE STRANDS | INTACT STRANDS | EXIT LOCATION |
|---|---|---|
| 40d | 60S5 | 52d |
| 40e | 60Z6 | 52e |
| 40f | 60Z1 | 52f |
| 40g | 60S2 | 52g |
| 40h | 60S3 | 52h |
| 40i | 60Z2 | 52i |
| 40j | 60Z3 | 52j |
| 40k | 60S6 | 52k |
| 40l | 60S1 | 52l |

Once these associations are defined, what will be referred to herein as a follow process will be performed for each associated pair of one loose strand 40 and its associated intact strand 60. The follow process involves extending the loose strand 40 along its associated intact strand 60 and either passing the loose strand 40 over or under any intact strands crossing the associated intact strand and making at least one rotation around the associated intact strand.

As examples of loose strands following Z-strands, FIG. 8 illustrates the resulting structure obtained by a portion of the follow process for loose strands 40*i* and 40*j* as they follow associated intact strands 60Z2 and 60Z3, respectively. Because the intact strands 60Z2 and 60Z3 are Z-strands in FIG. 8, the loose strands 40*i* and 40*j* encounter crossing intact S-strands at spaced locations along the length of the associated intact Z-strands 60Z2 and 60Z3. The loose strands are passed over the first crossing S-strand, under the next crossing S-strand, over the next crossing S-strand, over the next crossing S-strand, and then around the associated Z-strand. This pattern may be repeated or extended as many times as necessary to form a splice meeting the operational requirements of the rope system 20.

As examples of loose strands following S-strands, FIG. 9 illustrates the resulting structure obtained by a portion of the follow process for loose strands 40*c* and 40*d* as they follow associated intact strands 60S4 and 60S5, respectively. Because the intact strands 60S4 and 60S5 are S-strands, the loose strands 40*c* and 40*d* encounter crossing intact Z-strands at spaced locations along the length of the associated intact S-strands 60S4 and 60S5. The loose strands are passed over the first crossing Z-strand, under the next crossing Z-strand, over the next crossing Z-strand, over the next crossing Z-strand, and then around the associated S-strand. Again, this pattern may be repeated or extended as many times as necessary to form a splice meeting the operational requirements of the rope system 20.

Figure 10:
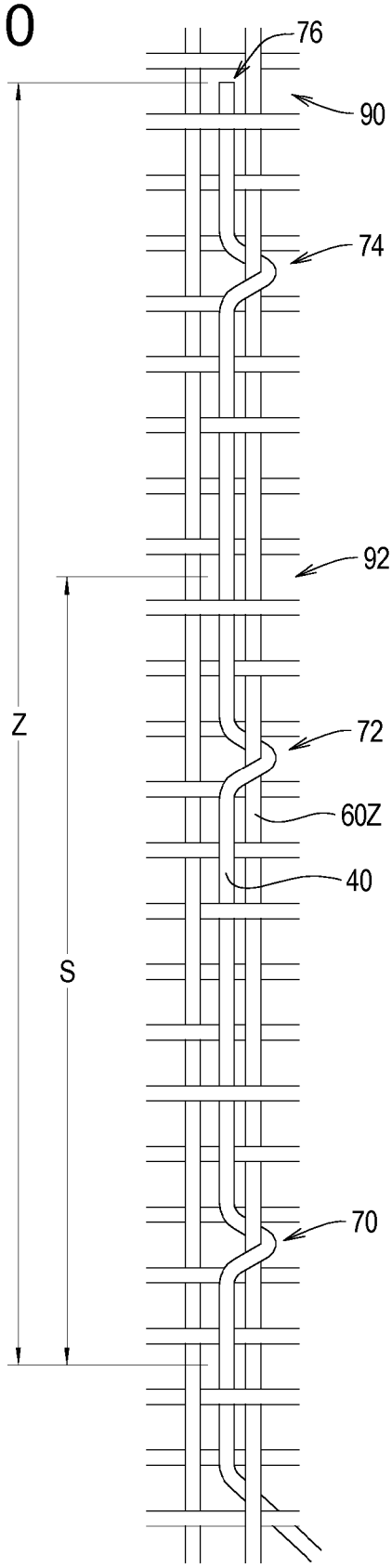
FIG. 10 is a two-dimensional view illustrating an example complete following step of the example splice process.

FIG. 10 illustrates more completely the example follow pattern obtained by a loose strand 40 following an intact Z-strand 60Z. It should be noted that FIG. 10 is somewhat schematic in that the picture follows the Z-axis associated with the Z-strand 60Z as if that Z-axis was straightened out into a straight line rather than a helix.

In any event, the follow process illustrated in FIG. 10 for the example rope system 20 begins by passing the following loose strand 40 over the first crossing S-strand, under the second crossing S-strand, over the third and fourth crossing S-strands, and around the associated Z-strand 60Z at a first wrap location 70. At that point, the following loose strand 40 is passed over the next two crossing S-strands, under the next crossing S-strand, over the next two crossing S-strands, under the next crossing S-strand, over the next two crossing S-strands, and then a second time around the associated Z-strand 60Z at a second wrap location 72. The pattern is thus stretched out between the first and second wrap locations 70 and 72. In the example shown in FIG. 10, this stretched out pattern is repeated one more time. After the following loose strand 40 extends or wraps around the associated Z-strand 60Z for the third time at a third wrap location 74, the following loose strand is passed over the next two crossing S-strands and under a final crossing S-strand to bury the very end of the loose strand 40 at a terminal location 76 within the rope structure 30.

FIG. 10 further illustrates that, to begin tapering the splice system 22, the loose strands following associated S-strands may be terminated after the second wrap location 72 at which that the following loose strand 40 extends or wraps around its associated S-strand 60S. Alternatively, a similar tapered structure may be obtained by terminating the Z-strands before the S-strands are terminated. In either case, the overall splice system 22 comprises a first section 80 having a length L5 and a second section 82 having a length L6 (FIGS. 4C-F and 5). The cross-sectional area of the first section 80 of the splice system 22 is larger than a cross-sectional area of the second section 82 of the splice system 22, and cross-sectional area of the second section 82 of the splice system 22 is larger than a cross-sectional area of the main portion 24 of the rope structure 20. The cross-sectional area of the example splice system 22 thus decreases from the eye portion 26 to the main portion 24 of the rope. For an even more gradual decrease in cross-sectional area, the termination points and/or wrapping locations of each individual loose strand 40 may be staggered along the length of the splice system 22 to minimize the thickness of the splice system 22 at any give location.

Referring now to FIGS. 4D and 10, it can be seen that six ends associated with the loose strands following intact S-strands extend from the rope structure 30 at a first termination location 90. As further shown in FIG. 4E, continuing the follow process with loose strands following intact S-strands results in six ends associated with the loose strands following these S-strands extending from the rope structure at a second termination location 92. These first and second termination locations 90 and 92 are also depicted in FIG. 10.

The loose strands 40 are slightly oversized to facilitate the follow process described above, and the extra portions of the loose strands remaining as shown in FIG. 4E are trimmed and otherwise finished such that the rope structure 30 is configured to yield the rope system 20 as shown in FIG. 4F.

The process of associating loose strands with either S-strands or Z-strands and the follow process are determined based on the characteristics of the particular rope structure 30 and particular resulting rope systems 20. With different rope structures and rope systems, different associations between loose strands and intact strands may be made, both for twelve strand rope structures and certainly for rope structures having fewer or more than twelve strands. And the operational use of the rope system 20 may dictate a longer or shorter spacing between wrap locations and different over and under passes of intact strands crossing the followed intact strand. The example rope system 20 is thus but one example of many rope systems that may be made using the principles of the present invention.

Figure 12:
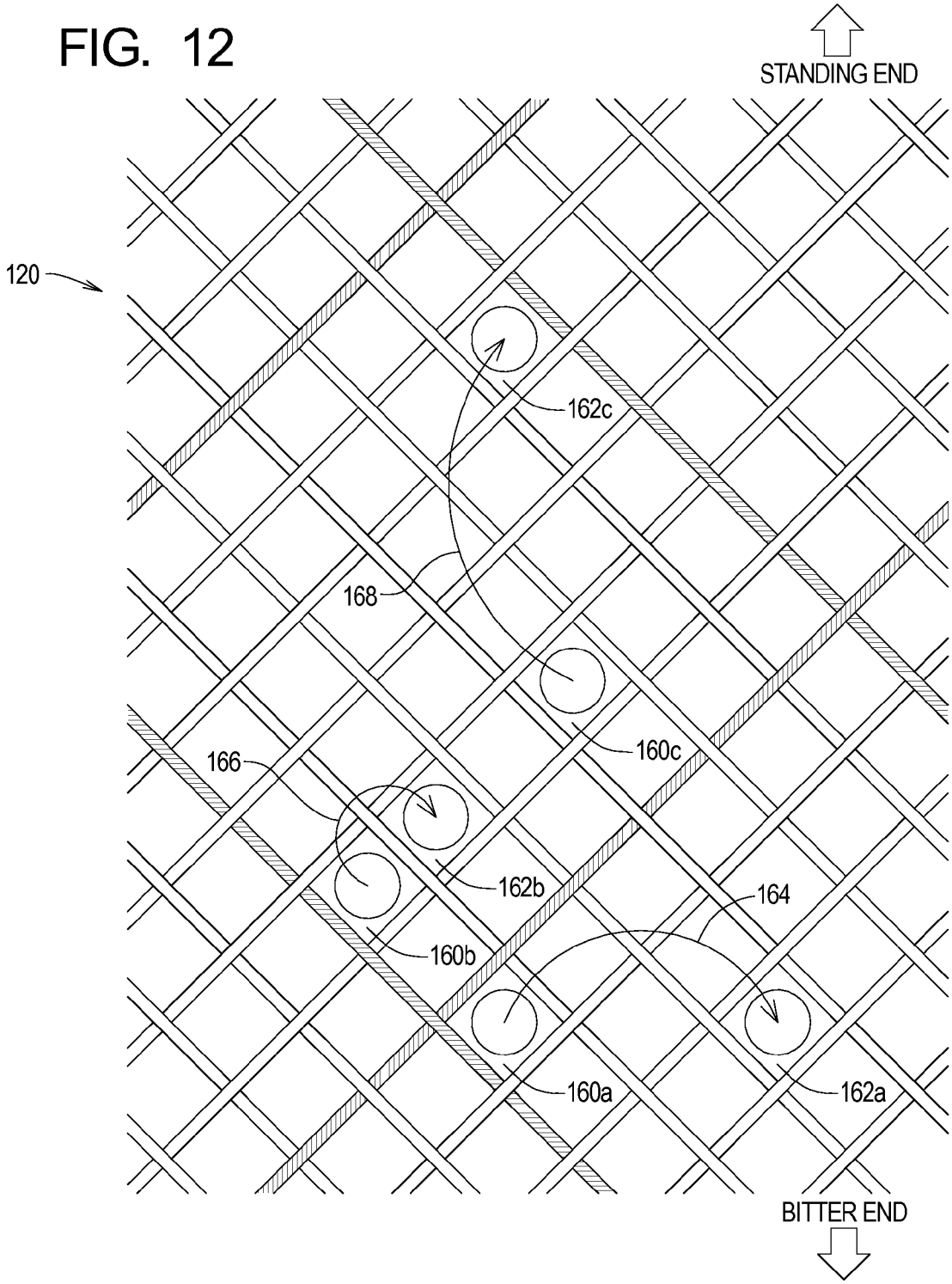
FIG. 12 is a two-dimensional view illustrating is a two-dimensional view illustrating a relative reference system of the first example coordinate system and method of the present invention.

Turning now to FIGS. 12 and 13 of the drawing, a novel coordinate system or method of defining a particular splice configuration will be used to describe an example of a splice system such as the splice system 22 constructed in accordance with, and embodying, the principles of the present invention.

Figure 11:
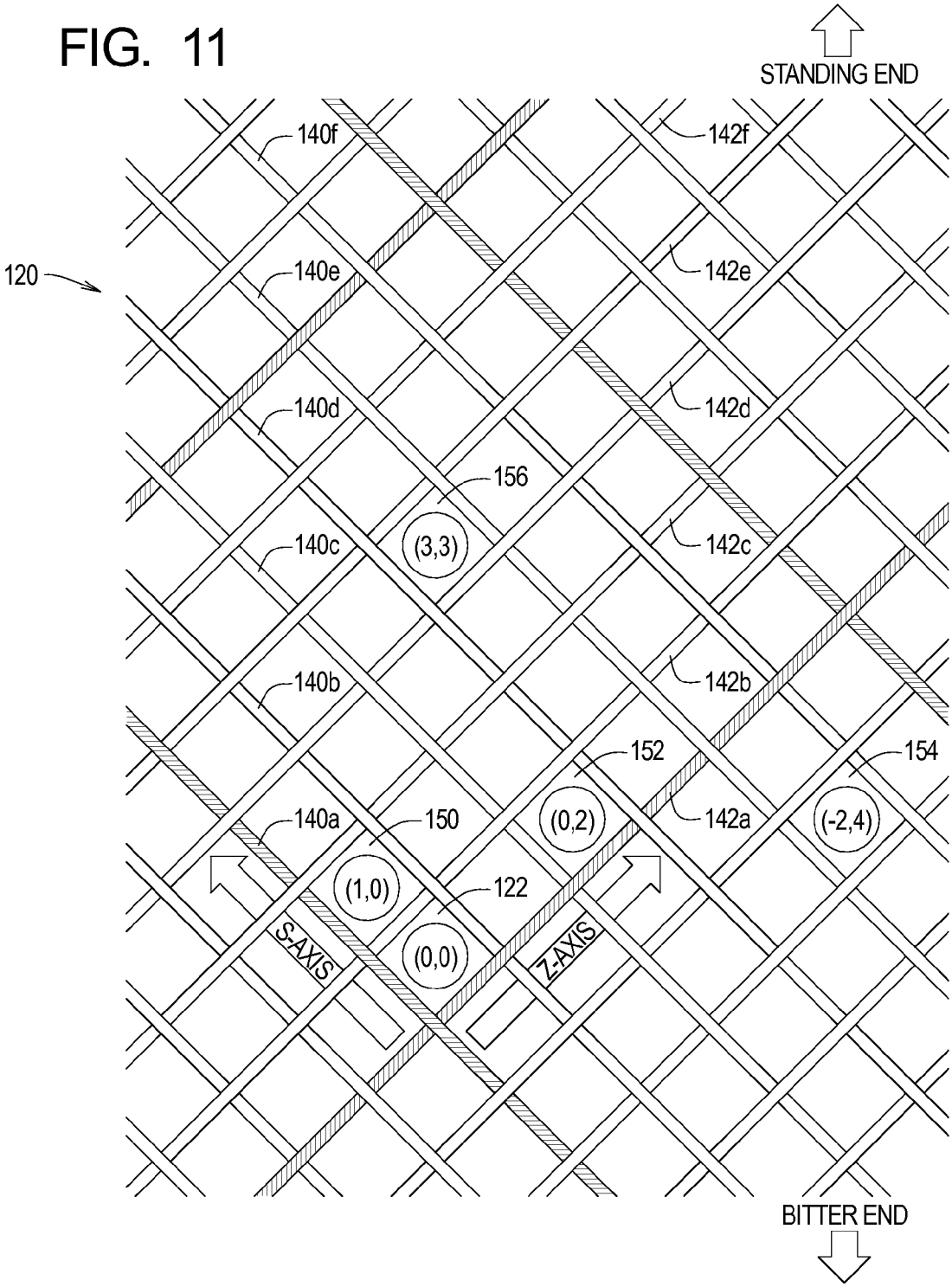
FIG. 11 is a two-dimensional view illustrating an absolute reference system of a first example coordinate system and method of the present invention.

Referring initially to FIG. 11, depicted therein is a coordinate system or method that may be used to specify a particular splice pattern for braided ropes. FIG. 11, like FIG. 5A, schematically represents a three-dimensional rope structure using a two dimensions.

As discussed above, braided ropes are formed of strands that extend along an S-axis and a Z-axis. The coordinate system or method of the present invention makes use of these axes to define locations along the rope. Further, a braided rope structure defines what will be referred to as rope openings between each pair of adjacent S-strands and each pair of adjacent Z-strands. These rope openings allow access to the interior space defined by a particular braided rope structure. One or more loose strands may be inserted from the exterior of the rope structure into the interior spaced defined by the rope structure or from the interior of the rope structure to the exterior of the rope structure through anyone of these rope openings.

The coordinate system or method of the present invention identifies a particular rope opening of a particular rope structure as an origin opening and uses a first or absolute numerical coordinate system that identifies every other rope opening in the particular rope structure with respect to the defined origin opening and the S- and Z-axes defined with respect to that particular rope structure. Every other rope opening is identified by a positive or negative integer for each of the S- and Z-axes. Spaces towards the bitter end of the rope structure from the origin opening are assigned negative integers, while spaces towards the standing end of the rope structure from the origin opening are assigned positive integers. The notation for the first or absolute numerical coordinate system takes the form of integers within a set of parenthesis (e.g., (s,z)).

The coordinate system or method of the present invention may further use an alternate relative numerical coordinate system to identify the relative position of one rope opening with respect to another opening. This alternate relative numerical coordinate system is of particular significance when identifying or implementing a splice pattern remote from the origin opening. The notation for the second or relative numerical coordinate system takes the form of integers within a set of brackets (e.g., <s,z>).

Given a system for identifying every rope opening defined by a particular rope structure, the particular pattern of tucks and wraps that a given loose strand must follow to obtain a predefined splice system may be defined. In particular, specifying a succession of rope openings using the numerical reference system described above identifies the rope openings that the loose strand alternately enters (in) and exits (out) or exits (out) and enters (in) as the predefined splice system is formed.

In addition, the loose strands may further be uniquely identified to facilitate the use of the coordinate system or method of the present invention. For example, the loose strands formed at the bitter end of a twelve strand rope comprise six S-strands identified using the upper case letters A, B, C, D, E, and F and six Z-strands using the lower case letters a, b, c, d, e, and f. When two or more strands are handled together and follow identical routs may be represented by grouping or concatenating their indices (e.g., As or AB).

Additionally, a particular splice system may require that a particular loose strand be split as the splice system is formed. For example, a strand may be split to facilitate the formation of a tapered splice. If a strand is split, an apostrophe (') may be added to the letter associated with the strand before the split (e.g., strand A is split to form a strand identified as A').

Referring now back to FIG. 11, depicted therein is a rope structure 120 in which one of the rope openings is defined as an origin opening 122. FIG. 11 further contains arrows 130 and 132 that indicate the origin S-axis and origin Z-axis, respectively, associated with the origin opening 122. Again, the example rope structure 120 is a twelve strand braided rope structure comprising six S-axes and associated S-strands 140*a*, 140*b*, 140*c*, 140*d*, 140*e*, and 140*f* and six Z-axes and associated Z-strands 142*a*, 142*b*, 142*c*, 142*e*, 142*e*, and 142*f*. S-strand 140*a* is associated with the origin S-axis 130, while strand 142*a* is associated with the origin Z-axis 132. FIG. 11 further shows, as examples, rope openings 150, 152, 154, and 156 that are defined using the coordinate system of the present invention as (1,0), (0,2), (−2,4), and (3,3), respectively.

Referring for a moment to FIG. 12, an example of the second or relative numerical coordinate system is depicted. The section of the rope structure 120 depicted in FIG. 12 is remote from the origin opening 122, so the absolute reference system may be somewhat difficult to use at this location. Instead, FIG. 12 illustrates a first pair of rope openings 160*a* and 162*a*, a second pair of rope openings 160*b* and 162*b*, and a third pair of rope openings 160*c* and 162*c*. Arrows 164, 166, and 168 indicate that, with reference to each of the three pairs of rope openings identified in FIG. 12, the rope openings 160*a*, 160*b*, and 160*c* are what will be referred to as reference openings, and the rope openings 162*a*, 162*b*, and 162*c* are what will be referred to herein as destination openings. In this context, the relationship between the openings 160*a* and 162*a* of the first pair of rope openings will be identified as <2,−2>, the relationship between the openings 160*b* and 162*b* of the first pair of rope openings will be identified as <0,1>, and the relationship between the openings 160*c* and 162*c* of the first pair of rope openings will be identified as <3,2>.

The coordinate system or method described above is applied to an example splice system of the present invention. In particular, the following Tables B, C, and D describe the formation of an example splice system of the present invention.

TABLE B

| Strand | in | out | Notes |
|---|---|---|---|
| AaBbCcDdEeFf | | Unbraid up to mark 1 | |
| A | (0, 0) | (1, 2) | Starting positions |
| a | (0, 0) | (0, 1) | |
| B | (0, 0) | (0, 2) | |
| b | (0, 0) | (−1, 1) | |
| C | (0, 0) | (−1, 5) | |
| c | (0, 0) | (−2, 4) | |
| D | (0, 0) | (−2, 5) | |
| d | (0, 0) | (−3, 4) | |
| E | (0, 0) | (3, 0) | |
| e | (0, 0) | (2, −1) | |
| F | (0, 0) | (2, 0) | |
| f | (0, 0) | (1, −1) | |

Table B specifies that all of the loose strands are inserted into the rope through the origin opening and the removed from the rope at various initial exit locations such as the exit locations 54 depicted and described above.

With loose strands extending through the corresponding initial exit locations as described above, the relative coordinate system is used to define the follow process defining the interaction of each loose strand with the rope structure. The following Table C indicates that the follow pattern performed by the individual S-strands:

TABLE C

| Strand | in | out | Notes |
|---|---|---|---|
| B, D, F | <0, 1><br><0, 4><br><0, 6> | <0, 2><br><−1, 4><br><0, 7> | First Set of Tucks |

TABLE C-continued

| Strand | in | out | Notes |
|---|---|---|---|
| B, D, F | <0, +2> | <0, +3> | Repeat 3 times |
| | <0, +5> | <−1, +5> | |
| | <0, +7> | <0, +8> | |
| A, C, E | <1, 0> | <2, 0> | First Set of Tucks |
| | <4, 0> | <4, −1> | |
| | <6, 0> | <7, 0> | |
| A, C, E | <+2, 0> | <+3, 0> | Repeat 3 times |
| | <+5, 0> | <+5, −1> | |
| | <+7, 0> | <+8, 0> | |

The following Table D indicates that the follow pattern performed by the individual Z-strands:

TABLE D

| Strand | in | out | Notes |
|---|---|---|---|
| a, c, e | <0, 1> | <0, 2> | First Set of Tucks |
| | <0, 4> | <−1, 4> | |
| | <0, 6> | <0, 7> | |
| a, c, e | <0, +2> | <0, +3> | Repeat 2 times |
| | <0, +5> | <−1, +5> | |
| | <0, +7> | <0, +8> | |
| b, d, f | <1, 0> | <2, 0> | First Set of Tucks |
| | <4, 0> | <4, −1> | |
| | <6, 0> | <7, 0> | |
| b, d, f | <+2, 0> | <+3, 0> | Repeat 2 times |
| | <+5, 0> | <+5, −1> | |
| | <+7, 0> | <+8, 0> | |

In addition to the coordinate systems and methods and reference systems described above, the rope structure itself may be altered with indicia that facilitate the implementation of a splice system using the coordinate systems and methods of the present invention. For example, the loose ends may be color coded, cross-hatched, and/or labeled with the information that facilitates the identification of the individual strands when performing the follow process required to form a particular splice system. Further, portions of the intact portion of the rope structure may be identified using indicia to indicate reference points or structures such as the origin opening and/or the origin S-strand and origin Z-strand. Such reference points or structures may also facilitate the identification of particular rope openings when performing the follow process required to form a particular splice system.

The present invention may be implemented using forms other than those specifically described above.

What is claimed is:

1. A rope system comprising:

a rope structure comprising an intact portion comprising intact strands and a disassembled portion comprising loose strands; wherein the loose strands are passed into an interior of the rope structure;

each loose strand is passed from the interior of the rope structure to the exterior of the rope structure adjacent to an associated intact strand;

each loose strand is extended along and wrapped around its associated intact strand at at least one wrap location; and each loose strand is wrapped around its associated intact strand at a plurality of wrap locations.

2. A rope system as recited in claim 1, in which:

the intact strands comprise at least one S-strand and at least one Z-strand;

each loose strand following an associated intact S-strand passes under at least one crossing Z-strand; and each loose strand following an associated intact Z-strand passes under at least one crossing S-strand.

3. A rope system as recited in claim 1, in which:

the intact strands comprise a plurality of S-strands and a plurality of Z-strands;

each loose strand following an associated intact S-strand passes over at least one crossing Z-strand and under at least one crossing Z-strand; and each loose strand following an associated intact Z-strand passes under at least one crossing S-strand.

4. A rope system comprising:

a braided rope structure defining an interior and an exterior and comprising an intact portion comprising a plurality of intact S-strands and a plurality of intact Z-strands, and a disassembled portion comprising a plurality of loose strands; wherein each intact S-strand crosses a plurality of intact Z-strands;

each intact Z-strand crosses a plurality of intact S-strands;

the plurality of loose strands is passed into the interior of the rope structure;

each loose strand is passed from the interior of the rope structure to the exterior of the rope structure adjacent to one of an associated intact S-strand and an associated intact Z-strand; and each loose strand associated with one of the intact S-strands is extended under at least one intact Z-strand crossing the associated intact S-strand and over at least one intact Z-strand crossing the associated intact S-strand and wrapped around its associated intact S-strand; and each loose strand associated with one of the intact Z-strands is extended under at least one intact S-strand crossing the associated intact Z-strand and over at least one intact S-strand crossing the associated intact Z-strand and wrapped around its associated intact Z-strand.

5. A rope system as recited in claim 4, in which:

each loose strand following an intact S-strand is wrapped around its associated intact S-strand a plurality times; and each loose strand following an intact Z-strand is wrapped around its associated intact Z-strand a plurality times.

6. A rope system as recited in claim 4, in which:

the rope structure is a twelve strand braided rope comprising six intact S-strands and six intact Z-strands;

each loose strand following an associated intact S-strand is extended over or under at least six intact Z-strands crossing the associated intact S-strand; and each loose strand following an associated intact Z-strand is extended over or under at least six intact S-strands crossing the associated intact Z-strand.

7. A rope system as recited in claim 6, in which:

each intact S-strand is associated with one of the loose strands; and each intact Z-strand is associated with one of the loose strands.

8. A rope system as recited in claim 4, in which the loose strands engage a splice portion of the rope structure such that a loop is formed in the rope structure.

9. A method of forming a rope system comprising:

providing a braided rope structure defining an interior and an exterior and comprising an intact portion comprising a plurality of intact S-strands and a plurality of intact Z-strands, and a disassembled portion comprising a plurality of loose strands, where each intact S-strand crosses a plurality of intact Z-strands;

each intact Z-strand crosses a plurality of intact S-strands;

passing the plurality of loose strands into the interior of the rope structure;

passing each loose strand from the interior of the rope structure to the exterior of the rope structure;

associating each loose strand with one of the intact S-strands or one of the intact Z-strands; and extending each loose strand associated with one of the intact S-strands under at least one intact Z-strand crossing the associated intact S-strand and over at least one intact Z-strand crossing the associated intact S-strand; and wrapping each loose strand associated with one of the intact S-strands around its associated intact S-strand;

extending each loose strand associated with one of the intact Z-strands under at least one intact S-strand crossing the associated intact Z-strand and over at least one intact S-strand crossing the associated intact Z-strand; and wrapping each loose strand associated with one of the intact Z-strands around its associated intact Z-strand.

10. A method as recited in claim 9, further comprising the steps of:

wrapping each loose strand following an intact S-strand around its associated intact S-strand a plurality times; and wrapping each loose strand following an intact Z-strand around its associated intact Z-strand a plurality times.

11. A method as recited in claim 9, in which:

the step of proving the rope structure comprises the step of providing a twelve strand braided rope comprising six intact S-strands and six intact Z-strands; wherein each loose strand following an associated intact S-strand is extended over or under at least six intact Z-strands crossing the associated intact S-strand; and each loose strand following an associated intact Z-strand is extended over or under at least six intact S-strands crossing the associated intact Z-strand.

12. A method as recited in claim 11, further comprising the steps of:

associating each intact S-strand with one of the loose strands; and associating each intact Z-strand with one of the loose strands.

13. A rope system comprising:

a rope structure comprising an intact portion comprising intact strands and a disassembled portion comprising loose strands; wherein the loose strands are passed into an interior of the rope structure;

each loose strand is passed from the interior of the rope structure to the exterior of the rope structure adjacent to an associated intact strand;

each loose strand is extended along and wrapped around its associated intact strand at at least one wrap location;

the intact strands comprise at least one S-strand and at least one Z-strand;

each loose strand following an associated intact S-strand passes under at least one crossing Z-strand; and each loose strand following an associated intact Z-strand passes under at least one crossing S-strand.

14. A rope system as recited in claim 13, in which:

the intact strands comprise a plurality of the S-strands and a plurality of the Z-strands;

each loose strand following an associated intact S-strand passes over at least one crossing Z-strand and under at least one crossing Z-strand; and each loose strand following an associated intact Z-strand passes under at least one crossing S-strand.

* * * * *